US006327871B1

(12) United States Patent
Rafalovich

(10) Patent No.: US 6,327,871 B1
(45) Date of Patent: Dec. 11, 2001

(54) REFRIGERATOR WITH THERMAL STORAGE

(76) Inventor: Alexander P. Rafalovich, 8309 Lacevine Rd., Louisville, KY (US) 40220

( * ) Notice: Subject to any disclaimer, the term of this patent is extended or adjusted under 35 U.S.C. 154(b) by 0 days.

(21) Appl. No.: 09/550,057

(22) Filed: Apr. 14, 2000

(51) Int. Cl.[7] ..... F25D 17/02

(52) U.S. Cl. ..... 62/434; 62/267; 62/431; 62/432; 62/441; 62/442

(58) Field of Search ..... 62/267, 434, 431, 62/432, 441, 442

(56) References Cited

U.S. PATENT DOCUMENTS 3,768,274 * 10/1973 Fink ..... 62/159
4,269,036 * 5/1981 Koide et al. ..... 62/159
4,712,387 * 12/1987 James et al. ..... 62/434
4,788,832 * 12/1988 Aoki et al. ..... 62/382
4,854,130 * 8/1989 Naruse et al. ..... 62/352
4,949,551 * 8/1990 Gergory ..... 62/196.4
5,598,716 * 2/1997 Tanaka et al. ..... 62/185
5,607,013 * 3/1997 Inoue et al. ..... 165/207
5,964,101 * 10/1999 Schulak et al. ..... 62/430
6,205,795 * 3/2001 Backman et al. ..... 62/79

* cited by examiner

*Primary Examiner*—William Doerrler
*Assistant Examiner*—Mark Shulman

(57) ABSTRACT

A refrigerator with at least one medium/low temperature-freezing compartment and a compression refrigeration system with a thermal storage, and a method of operating the refrigeration system with a thermal storage are provided. The refrigeration system includes a compressor, a condenser, a thermal storage, a medium/low temperature evaporator, a first expansion device, a second expansion device, a bypass line to bypass the second expansion device, a refrigerant valve to direct refrigerant flow after the thermal storage either to the bypass line or to the second expansion device, and control means to control temperature in the compartments, the compressor and the valve operations. The method comprises steps of charge and discharge of the thermal storage. During the thermal storage discharge refrigerant evaporates in the medium/low temperature evaporator providing refrigeration to the freezing compartment. Further disclosed is the thermal storage-heat exchanger that may supply a refrigeration compartment with the cooling potential. The method provides a reduction in energy consumption of the refrigerator by 30%.

27 Claims, 8 Drawing Sheets

REFRIGERATOR WITH THERMAL STORAGE

FIELD OF THE INVENTION

The present invention relates generally to refrigerators and refrigeration cycles with a thermal storage.

BACKGROUND OF THE INVENTION

The present invention relates to freezers and refrigerators. More particularly the present invention relates to household and commercial freezers and refrigerators with multiple compartments: including freezing or frozen food compartments and refrigeration or fresh food compartments.

For most of refrigerators and freezers, a compression refrigeration system is the source of negative thermal potential. Compression refrigeration system consists of a compressor, a condenser, a metering/expansion device, and a low temperature evaporator installed in a freezing compartment. In refrigerators the refrigeration compartment is connected to the freezing compartment through the openings in the mullion or clearance between the mullion and the refrigerator case. Low temperature evaporator cools air in the freezing compartment. Refrigeration compartment is mostly cooled when cold air from the freezing compartment flows into the refrigeration compartment and cools the air in the compartment, although part of the cooling potential comes into the refrigeration compartment due to the heat transfer through the mullion. The air movement between the compartments is by forced or natural convection.

It is widely recognized, however, that the cooling of the refrigeration compartment by low temperature potential from the freezing compartment reduces the refrigeration capacity and efficiency. Also the air circulation between both compartments causes drying of the food in the refrigeration compartment and excessive frost building in the freezing compartment.

Some designers have attempted to overcome these problems by installation of two evaporators: a low temperature evaporator in the frozen food compartment and a high temperature evaporator in the fresh food compartment. There is no necessity for any clearance or openings in the mullion separating the compartments. Thus, there is no air circulation between the compartments. That eliminates moisture movement between two compartments and reduces consumption of electricity. Yet, because the refrigeration system provides much higher capacity to the high temperature evaporator, to sustain high efficiency this evaporator must be big in size with preferably forced air convection. Otherwise, the temperature of the evaporator drops down considerably, thus decreasing efficiency of refrigeration. In refrigerators with variable speed compressor high temperature operation requires low compressor speed. Still the evaporator has to have relatively large heat transfer surface. Another problem for refrigerators with two separate evaporators is the existence of temperature swings in the fresh food compartment. Unlike frozen food that has both latent and sensible heat, specific heat of fresh food itself consists only of sensible heat. It means that at the time when the compressor is off, the temperature in the refrigeration compartment quickly rises. On the other hand, the proper food preservation limits the temperature range for refrigeration. It causes excessive number of power switching of the compressor, which, in turn, reduces its efficiency and reliability. Even with extra insulation of the fresh food compartment, if the refrigerator door is open for some time, or somebody puts a new warm portion of fresh food and/or water into the compartment, compressor should start operating. In a refrigerator with variable speed majority of the time the compressor can run with low speed and jump the speed when the door is open. However, low speed operation is not very efficient, besides, in systems with the capillary tube as an expansion device changing of refrigerant flow rate causes reduction in the system efficiency. To overcome these problems some designers use a thermal storage in the fresh food compartment. However, known designs of a thermal storage for refrigerators are complicated and expensive.

In freezers and most of the contemporary refrigerators the biggest part of the negative thermal potential escapes through the walls and doors of the freezing compartment. Thus, in freezers and even in refrigerators that have two separate evaporators the increase of the low temperature operation efficiency is extremely important.

The present invention relates to freezers and different refrigerators. The preferred refrigerators, disclosed herein, are refrigerator-freezers that include side-by-side models with and without the ice/water dispenser in the door, models with the freezer mounted on the top or at the bottom of the refrigeration cabinet, and models with multiple compartments.

SUMMARY OF THE INVENTION

According to the present invention, a refrigerator with at least one of refrigeration and/or freezing compartments and a compression refrigeration system operable in at least one of either a medium/low temperature cooling mode or a high/medium temperature cooling mode is provided. The compression refrigeration system comprises of a refrigerant circuit including a compressor and, in serial connection a compressor discharge line, a condenser, a first expansion device, a thermal storage with a thermal storage medium, a second expansion device, an evaporator, and a compressor suction line; a refrigerant bypass line for bypassing the second expansion device; a valve positioned to block flow through the bypass line, and control means for controlling the valve and the compressor.

The compression refrigeration system further comprises a first capillary tube as the first expansion device and a second capillary tube as the second expansion device. Further the first and the second capillary tubes of the refrigeration system are in heat transfer communications with the compressor suction line.

According to one aspect of the invention, an inlet of the bypass line is connected to the thermal storage and an outlet of the bypass line is connected to the evaporator, further the valve of the refrigeration system is a shut-off valve. According to another aspect of the invention, the inlet of the bypass line is also connected to the thermal storage and the outlet of the bypass line is connected to the compressor suction line, the valve is either a shut-off valve or a three-way valve. The compression refrigeration system with a three-way valve further comprises a check valve after the evaporator to block refrigerant flow from the compressor suction line to the evaporator.

Further in accordance with the present invention, the compression refrigeration system comprises a fan moving air around surfaces of the thermal storage to deliver the high/medium temperature cooling potential to the refrigeration compartment. The thermal storage consists of a container with a phase change material as a thermal storage medium, and a refrigerant coil to evaporate refrigerant that extracts heat from the thermal storage medium and to condense and subcool refrigerant that rejects heat to the thermal storage medium.

According to a yet further aspect of the present invention, the thermal storage container and the refrigerant coil are roll-bonded from metal sheets, wherein two internal sheets with formed internal channels make the refrigerant coil and external sheets with formed external channels make the thermal storage container for the thermal storage medium that is located between external walls of the internal sheets and internal walls of the external sheets. In accordance with another aspect of the invention, the thermal storage container is filled with water and opened to air, and the refrigerant coil is submerged in water in the container with fins emerging from water to increase heat transfer surface contacting with the air.

Further in accordance with the present invention, a refrigerator with refrigeration and/or freezing compartments is provided. The refrigerator comprises a compressor with suction and discharge ports, the compressor insulated from the compartments, a condenser outside of the compartments, insulated side, top, bottom and back walls, at least one door to get into the refrigerator, a mullion between the compartments, a thermal storage, an evaporator in the freezing compartment, a first capillary tube, a second capillary tube, refrigeration lines connecting in series the compressor discharge, the condenser, the first capillary tube, the thermal storage, the second capillary tube, the evaporator, and the compressor suction, a bypass refrigeration line to bypass the second capillary tube, a refrigerant valve to direct refrigerant flow after the thermal storage either to the bypass line or to the second capillary tube, and control means to control temperature in the compartments, the compressor and the valve operations.

Further the refrigerator comprises a first fan in the freezing compartment to deliver negative thermal potential from the evaporator, and the control means further controlling the first fan operations. According to yet another aspect of the invention, the refrigerator comprises a second fan in the refrigeration compartment to deliver negative thermal potential from the thermal storage, and the control means further controlling the second fan operations.

The thermal storage of the refrigerator comprises a container with a phase change material as a thermal storage medium and a refrigerant coil to evaporate refrigerant that extracts heat from the thermal storage medium and to condense and subcool refrigerant rejecting heat to the thermal storage medium. Further the thermal storage container and the refrigerant coil are roll-bonded from metal sheets, wherein two internal sheets with formed internal channels make the refrigerant coil and external sheets with formed external channels make the thermal storage container for the thermal storage medium that is located between external walls of the internal sheets and internal walls of the external sheets.

In accordance with yet another aspect of the invention, the thermal storage container is filled with water and opened to air, and the refrigerant coil is submerged in water in the container where fins emerge from water to increase the heat transfer surface that contacts with air.

Further in accordance with the present invention, the refrigeration compartment of the refrigerator comprises of at least one of high and low humidity sections and the thermal storage provides the cooling potential to the high humidity section while air circulates through the openings in the mullion between the freezing compartment and the low humidity section of the refrigeration compartment provides the cooling potential to the low humidity section.

Further the refrigerant valve is a shut-off valve. In accordance with yet another aspect of the present invention, the refrigerant valve is a three-way valve, and the refrigerator further comprises a check valve to block refrigerant flow from the compressor suction to the evaporator.

Further in accordance with the present invention, a method for refrigeration of enclosed compartments with a compression refrigeration system is provided. The refrigeration system includes a thermal storage to store high/medium temperature cooling potential; the thermal storage consists of a container with a thermal storage medium and a refrigerant coil. The system has in serial connection a compressor, a compressor discharge line, a condenser, a first expansion device, the refrigerant coil of the thermal storage, a second expansion device, a medium/low temperature evaporator to provide medium/low temperature refrigeration, and a compressor suction line. A refrigerant bypass line for bypassing the second expansion device and a valve in the refrigerant bypass line positioned to allow or to block flow through the bypass line are also included. The method comprises the steps of charge and discharge of the thermal storage. During the thermal storage charge gaseous refrigerant after the compressor flows to the condenser, liquefies there, expands after the condenser in the first expansion device, flows to the thermal storage, and evaporates in the thermal storage refrigerant coil that provides negative thermal potential to the thermal storage medium. From the thermal storage refrigerant flows through the bypass line to the compressor suction line. During the thermal storage discharge gaseous refrigerant flows in the refrigerant circuit from the compressor to the condenser, liquefies there, then partly expands in the first expansion device, flows to the thermal storage, at least partly recondenses and subcools in the thermal storage refrigerant coil that extracts negative thermal potential from the thermal storage medium. From the thermal storage subcooled refrigerant expands in the second expansion device, and then evaporates in the medium/low temperature evaporator that provides medium/low temperature refrigeration to a first enclosed compartment. From the evaporator refrigerant flows back to the compressor.

In according with another aspect of the invention, during the thermal storage charge step the method further comprises flowing refrigerant after the bypass line to the evaporator and then to the compressor suction line.

Further the method provides high/medium temperature refrigeration to a second enclosed compartment during both the thermal storage charge and the thermal storage discharge when the thermal storage medium extracts high/medium temperature cooling potential to the second enclosed compartment.

DESCRIPTION OF THE PREFERRED EMBODIMENTS

Figure 1:
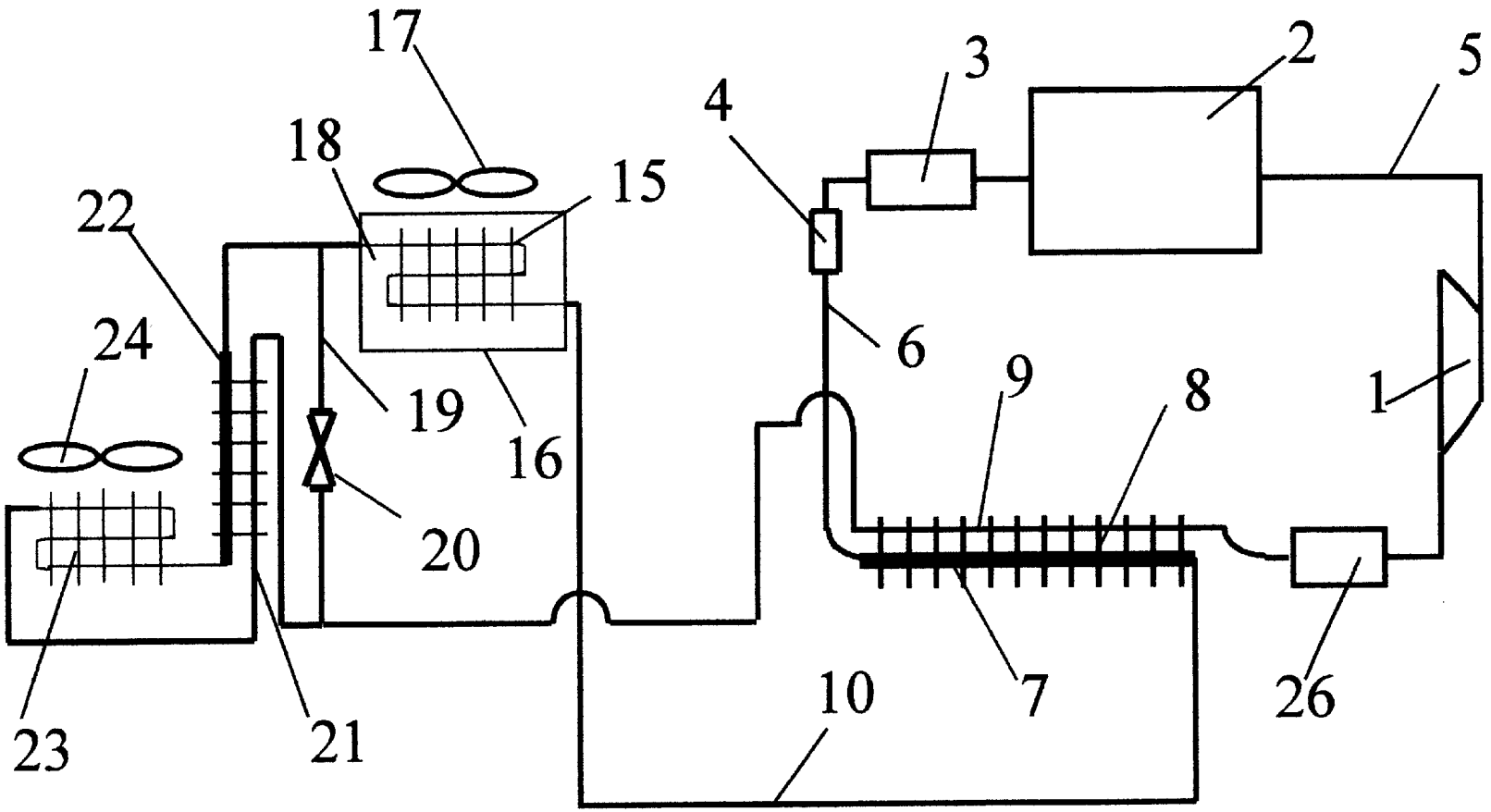
FIG. 1 is a diagrammatic view of one embodiment of refrigeration sealed system in according with the present invention showing a thermal storage, an evaporator, two expansion devices, and a bypass line with a shut-off valve.

A refrigeration sealed system (FIG. 1) consists of compressor 1, condenser 2, an optional receiver 3, an optional strainer-dryer 4, a first capillary tube 7, a thermal storage 16 that includes a container with a thermal storage medium 18 and a refrigerant coil 15, a bypass line 19 with a shut-off valve 20, a second capillary tube 22, an evaporator 23, an optional suction accumulator 26, and refrigerant lines 5,6, 9,10, and 21. There are also optional fans 24 to move air around evaporator 23 and 17 to move air around thermal storage 16. Condenser 2 may also have a fan for forced air convection (not shown). Capillary tubes 7 and/or 22 may be in heat exchange relation with refrigerant suction lines 9 and 21. Control system that is not shown on the diagram is also provided.

The sealed system operation consists of two steps:

1. Charge of the thermal storage. Shut-off valve 20 is open. High-pressure gaseous refrigerant after compressor 1 flows through refrigerant line 5 to condenser 2, where ambient air absorbs heat and refrigerant liquefies. Liquid refrigerant flows to the first capillary tube 7, expands there, and through refrigerant line 10 reaches the thermal storage coil 15. In coil 15 refrigerant evaporates, absorbing heat from the thermal storage medium to cool and/or freeze this medium, then through the shut-off valve 20, which is now in open position, refrigerant flows to the refrigerant line 9, which may be in heat exchange relation with capillary tube 7 to absorb heat from the tube 7 and to subcool refrigerant, and through optional suction accumulator 26 refrigerant returns to the suction of compressor 1. Fan 17 maybe on or off and fan 24 is off. If thermal storage 16 is located in a fresh food compartment of a refrigerator and fan 17 is on, the thermal storage provides the fresh food compartment with high/medium temperature cooling capacity. If fan 17 is off, cooling capacity provided to the fresh food compartment is limited by natural convection of air along heat transfer surface of thermal storage 16. In the refrigeration systems, wherein compressor 1 is a variable speed compressor, during the thermal storage charge the compressor preferably runs with low speed to reduce the load on condenser 2.

2. When thermal storage medium is partly or completely frozen, control system calls for cooling of the freezing compartment and closes shut-off valve 20, forcing refrigerant to flow through both first and second capillary tubes. High-pressure gaseous refrigerant after compressor 1 flows by refrigerant line 5 to condenser 2, where ambient air absorbs heat and refrigerant liquefies. Liquid refrigerant flows to first capillary tube 7. Because now the bypass line is shut off and refrigerant flows through both capillary tubes, the refrigerant flow rate considerably drops, and refrigerant only partly expands in the first capillary tube. This partly expanded refrigerant reaches the thermal storage 16 through refrigerant line 10. The saturating temperature of refrigerant now is above the freezing temperature of the thermal storage medium 18 and refrigerant vapor at least partly recondenses in the coil 15 of thermal storage 16 using the thermal potential stored in thermal storage medium 18. Thus, thermal storage 16 now works as a condenser-subcooler. After thermal storage 16 liquid refrigerant reaches second capillary tube 22, expands there and flows to evaporator 23. In evaporator 23 liquid refrigerant evaporates providing medium/low temperature cooling capacity to the freezing compartment, then vapor refrigerant flows through lines 21 and 9 and optional accumulator 26 to the suction of compressor 1. Either line 21, 9, or both 21 and 9 may be in heat transfer communications with capillary tubes 7 and 22 that subcools refrigerant before thermal storage 16 and evaporator 23. Fan 24 is on and fan 17 maybe on or off depending on the requirement of the refrigeration compartment. Obviously, in freezers there is no need to use fan 17 at all, because the only compartments are freezing compartments that require low temperature cooling capacity.

Figure 1A:
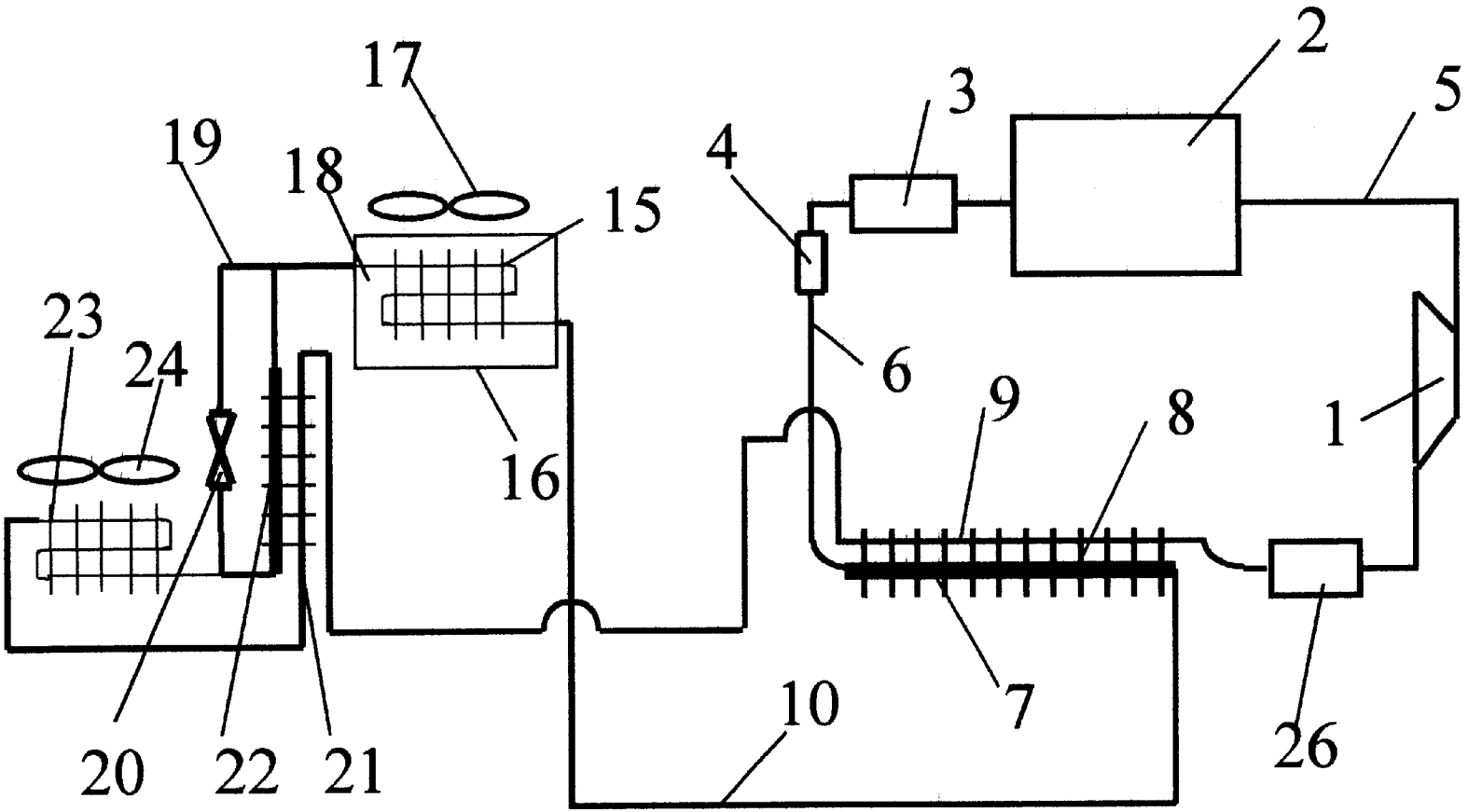
FIG. 1A depicts a diagrammatic view of the refrigeration sealed system of FIG. 1 with a change of the bypass line position.
Figure 2:
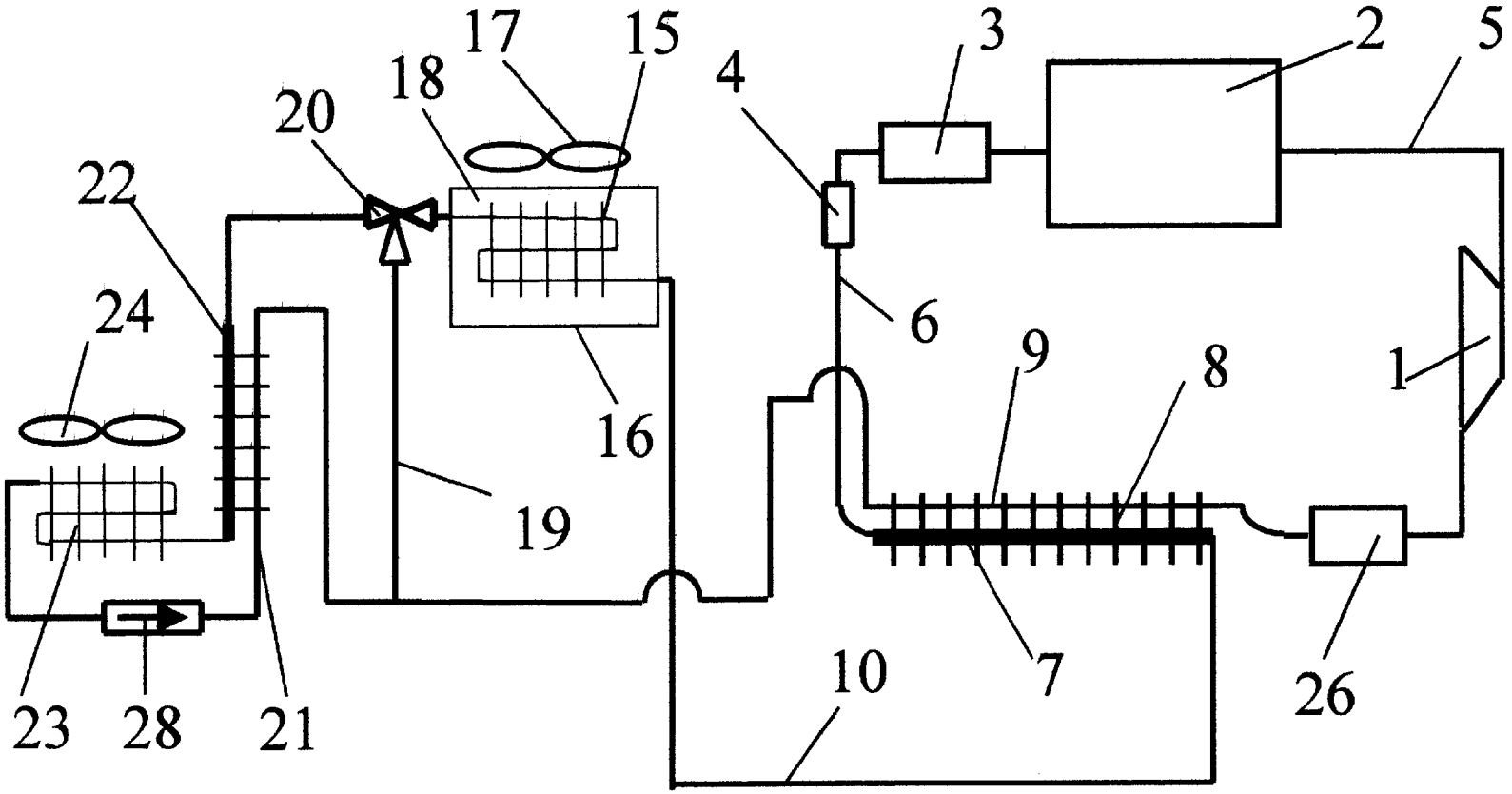
FIG. 2 shows a diagrammatic view of another embodiment of refrigeration sealed system in accordance with the present invention showing a thermal storage, an evaporator, two expansion devices, a bypass line, a three-way valve and a check valve to block refrigerant flow from the evaporator.

Two modification of design of FIG. 1 are presented in FIGS. 1A and 2.

FIG. 1A shows basically the same design as FIG. 1. The only difference is that during the thermal storage charge refrigerant after bypass line 19 flows to the evaporator and then to the suction of compressor 1. On one hand, when vaporized refrigerant flows through the evaporator, it increases the pressure drop. On the other hand, this flow pass allows avoiding accumulation of liquid refrigerant on the cold internal surface of medium/low temperature evaporator 23.

When the compressor is not in operation and during the high/medium temperature thermal storage charge operations, refrigerant vapor can migrate to the low temperature evaporator surface, liquefying there and rejecting heat to the freezing compartment. In design presented in FIG. 2 a three-way valve substitutes conventional two-way valve 20 of FIGS. 1 and 1A. In addition, a check valve 28 is also provided. Combination of these two valves doesn't allow penetration of vapor refrigerant to the evaporator at the time the compressor is off or the system charges the thermal storage according to the first step of operations. When the compressor is off, the three-way valve directs refrigerant to the coil of the thermal storage. The valve directs refrigerant to the evaporator only during step two—thermal storage discharge—medium/low temperature system operation. Thus, there is no accumulation of liquid refrigerant on the cold surface of the evaporator and the amount of refrigerant in the circulation is almost without change. That reduces the transient losses and makes the cycle more efficient.

Figure 3:
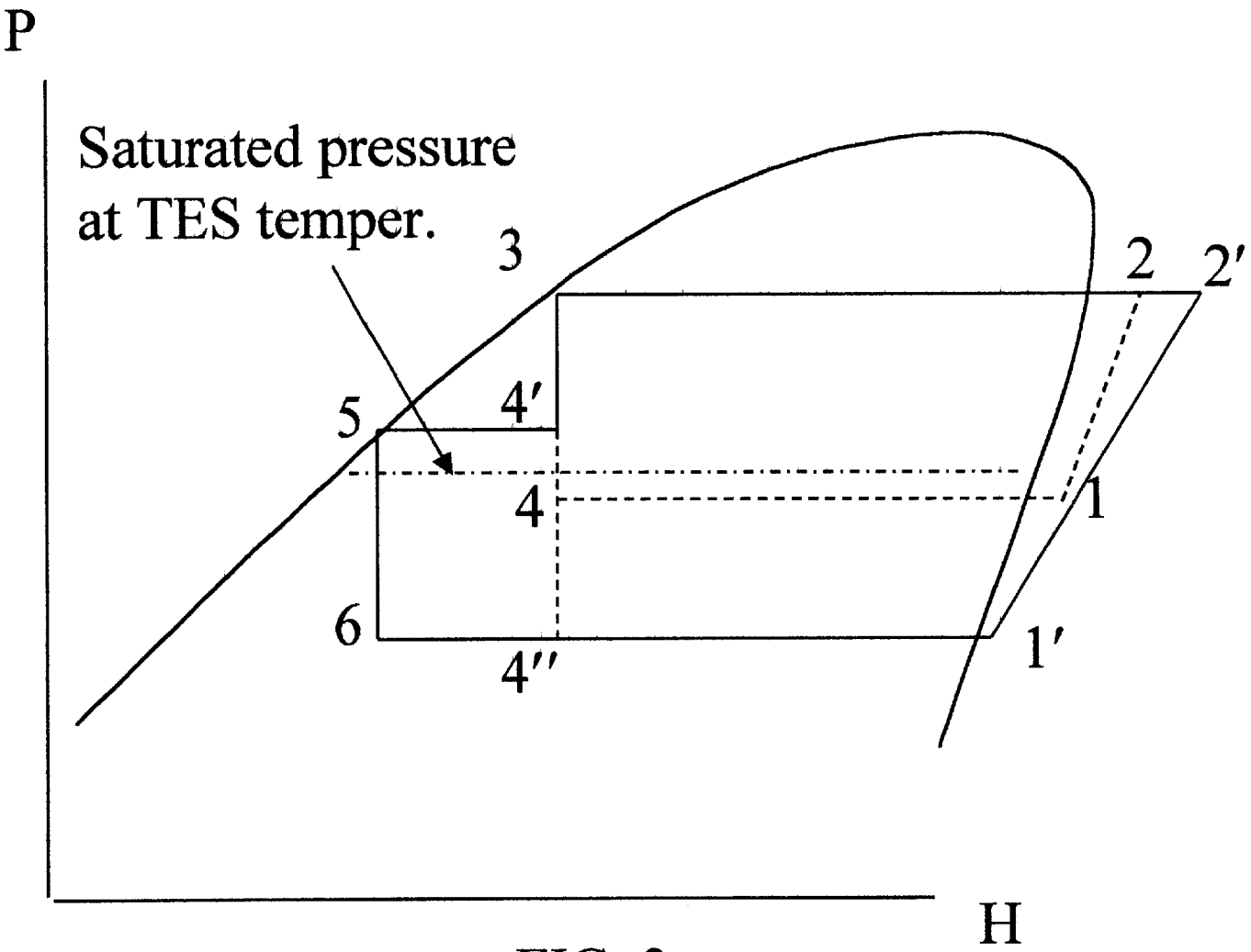
FIG. 3 shows a P-H diagram of the sealed systems of FIGS. 1, 1A, and 2.

FIG. 3 presents an H-P diagram of the refrigeration system according to FIGS. 1, 1A, and 2.

1. First step—high temperature system operation—charging the thermal storage is depicted in the rectangle 1-2-3-4. Dash line 1-2 represents compression in compressor 1, line 2-3 represents condensing in condenser 2, line 3-4 represents expanding in capillary tube 7, and line 4-1 represents evaporating in thermal storage coil 15.

Refrigerant evaporating in the thermal storage extracts heat from thermal storage medium 18. The best thermal storage media are phase change materials. These materials can absorb and reject heat with constant temperature. Dashed-dot line in FIG. 3 represents the refrigerant pressure at the temperature equal to the transition temperature of the phase change material.

During the thermal storage charge operation the refrigerant temperature is below the transition temperature of the phase change material. Thus, refrigerant extracts heat and freezes the material.

2. Second step of operation—low temperature refrigeration is depicted in the polygon 1'-2'-3-4'-5-6-1'. Line 1'-2' represents compression in compressor 1 (FIGS. 1, 1A, 2). Line 2'-3 represents condensing in condenser 2, line 3-4' represents expansion in first capillary tube 7, line 4'-5 represents recondensing and subcooling of refrigerant in thermal storage 16, line 5-6 represents expanding refrigerant in second capillary tube 22, line 6-1' represents evaporating of refrigerant in evaporator 23.

The low temperature capacity increase is shown in segment 6-4" of line 6-1'. This extra capacity is provided to the refrigerant in the thermal storage. FIG. 3 shows that after expansion in the first capillary tube—line 4'-5 refrigerant has a temperature above the transition temperature of the thermal storage medium. Thus, refrigerant rejects heat to the thermal storage medium melting this medium and recondenses and cools in the thermal storage after expansion in the first capillary tube. This allows us to use much more efficient high temperature refrigeration to increase capacity of low temperature refrigeration.

The cycle depicted in the polygon 1'-2'-3-4'-5-6-1' is different from a cycle with the conventional subcooling. The difference is in the expansion in the first capillary tube 7 that changes the refrigerant state in the thermal storage coil 15. Unlike a cycle with the conventional subcooling after refrigerant condensation where refrigerant in the subcooler is always in a liquid state, refrigerant in coil 15 is a mixture of vapor and liquid. Here is the main advantage of the new cycle-optimal amounts of refrigerant for both high and low temperature operations are very close. This allows us to either not use receiver 3 (FIGS. 1, 1A, and 2) or considerably decrease its volume.

The optimal transition temperature of phase change material depends on the condensing temperature and the temperature of low temperature evaporator. Because of low cost and clean properties, water or water based phase change materials are the first candidates.

Estimation shows the design with water as the thermal storage medium can increase cooling capacity of refrigeration system by 10–15% for refrigerant R-22 and by 15–20% for refrigerants R-134A, propane and iso-butane. Efficiency gain for different refrigerants will be from 10 to 15%. For high condensing temperatures, e.g. 120°–130° F., a phase change material with higher transition point may improve capacity and efficiency even more. For example, the use of a mixture of C12–C14 paraffin with the melting point of 47° F. (low cost material produced by Vista Chemical Company) as a thermal storage medium may increase the capacity of refrigeration system with R-134A refrigerant by 25%, and efficiency by 18%.

Figure 4:
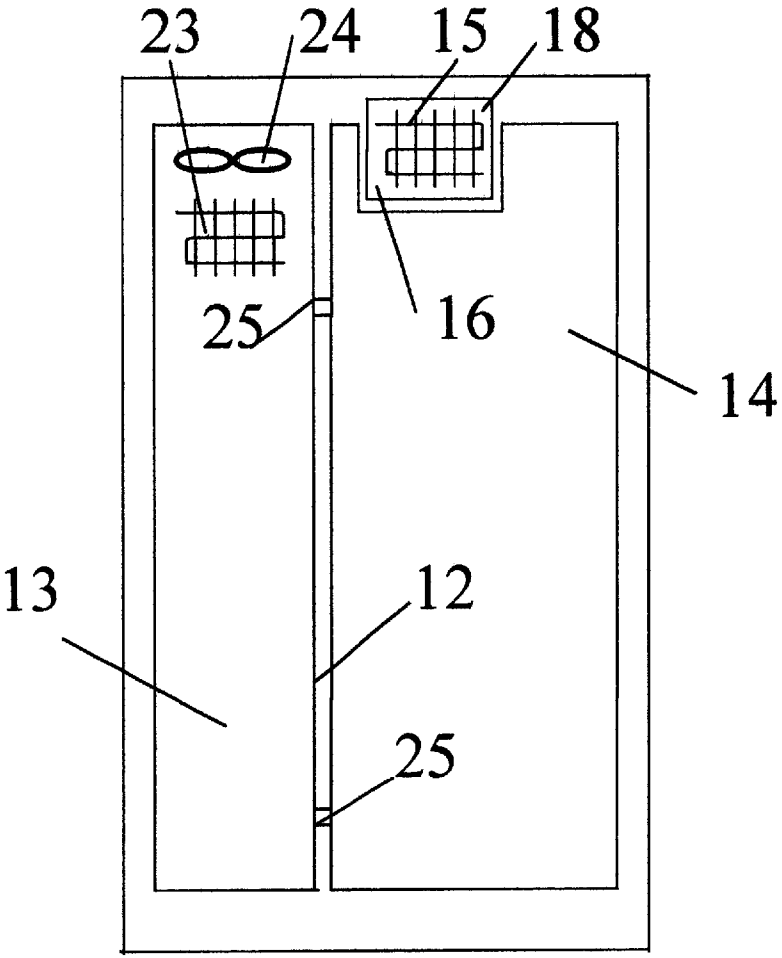
FIG. 4 depicts a schematic view of a refrigerator with a freezing and a fresh food compartments (doors are not shown), where an evaporator is in the freezing compartment and a thermal storage is installed in a wall of the refrigerator, and a refrigerant coil of the thermal storage is connected to the evaporator according to schematic of FIGS. 1, 1A and 2.

These numbers reflect the effect from the subcooling that is the only effect for freezers and for refrigerators where thermal storage 16 has limited heat transfer to the air in the refrigeration compartment. FIG. 4 shows an example of this type of refrigerator. Thermal storage 16 is built in one of the walls of refrigeration compartment 14. There is no fan 17 of FIGS. 1, 1A and 2 and cooling potential to the refrigeration compartment is provided by the conventional way, for example, by the air circulation from freezing compartment 13 through openings 25 in mullion 12.

On the contrary, if the thermal storage is also a heat exchanger and provides at least part of the cooling capacity to the refrigeration compartment, the efficiency of the refrigerator may be considerably higher. In this case, the refrigeration system must be designed to provide good heat transfer between the thermal storage and the air in the refrigeration compartment, and fan 17 will help.

Combined thermal storage-heat exchanger may be constructed using two different ways.

Figure 5:
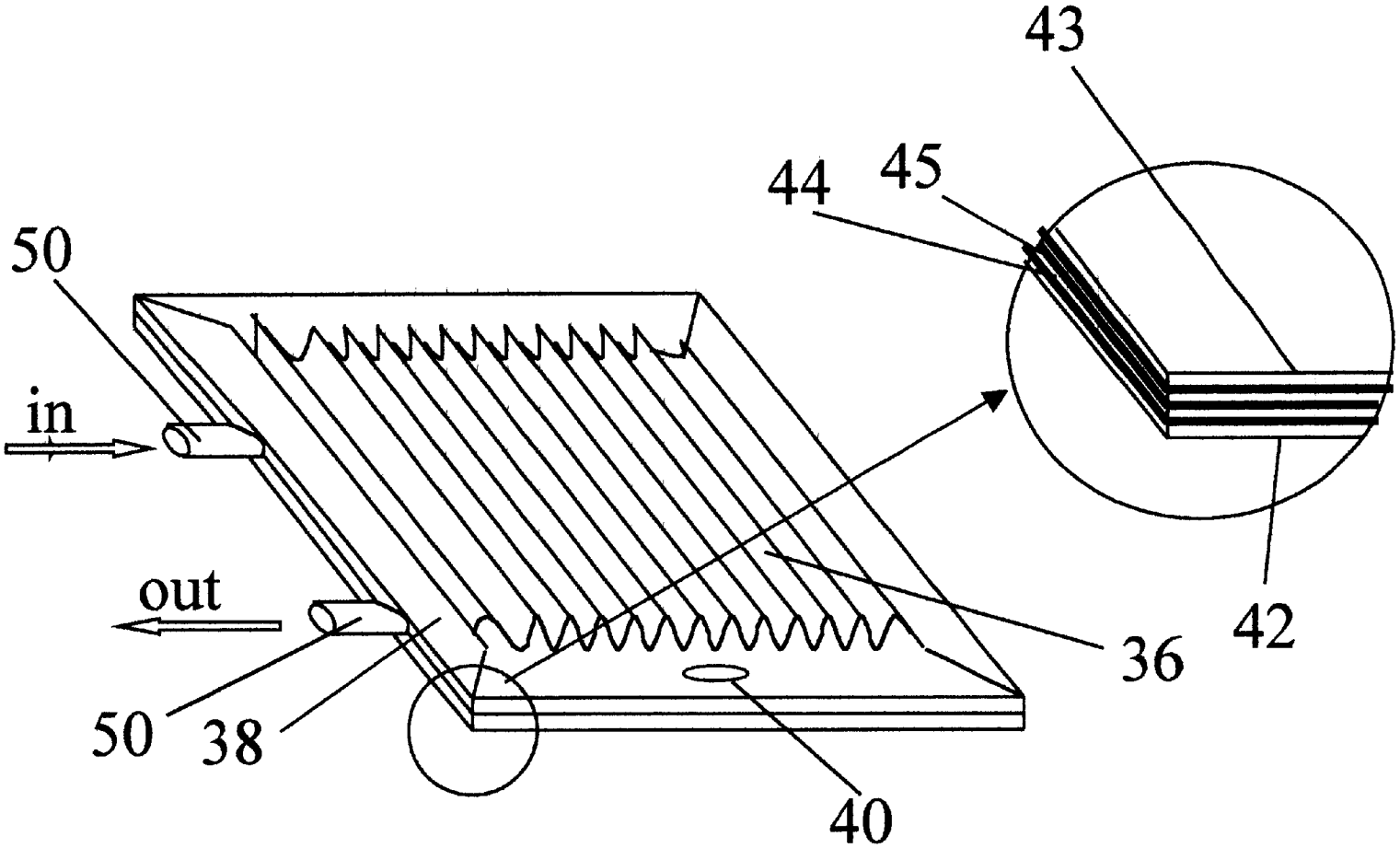
FIG. 5 shows a thermal storage of the roll-bond design where the external sheets make a hermetically sealed container for a thermal storage medium and internal sheets make a refrigerant coil.

1. The container is sealed. Outside walls of the thermal storage container have to be made from a thermo conductive material with developed outside surface. FIG. 5 shows a design of such thermal storage. It is a roll-bond four metal sheets heat exchanger. Two internal sheets 44 and 45 are bonded to each other with refrigerant channels formed after the bonding. These two sheets make an internal heat exchanger. Channels are connected to two ports 50 for inlet and outlet of the refrigerant. The design of this internal heat exchanger is close to the design of well-known roll-bond evaporators manufactured, for example, by Algood Company. Two external sheets 44 and 45 are bonded either to the internal sheets 42 and 43 or to each other by a method identical to roll bonding of conventional roll-bond evaporators. The internal space between sheets 42 and 44, and 43 and 45 is for the thermal storage medium that is loaded into the thermal storage through filling ports 40. To increase the surface contacting with air optional channels 36 in external sheets 44 and 45 may be formed. Material of the sheets of the thermal storage is preferably aluminum. Instead of four sheets the thermal storage can also be formed from three metal sheets. In this case one of the internal sheets is also an external one and only one of the external sheets, for example, sheet 44 is in the thermal storage. In this thermal storage the thermal storage medium is located between sheets 42 and 44 and only one side of the internal heat exchanger contacts the thermal storage medium.

It is mentioned above that the best thermal storage media are phase change materials. These materials can provide the refrigeration compartment with constant temperature close to the transition temperature of a phase change material. The material with too low of a transition temperature would not save energy. In a thermal storage designed exclusively for subcooling, i.e., for freezers, the material with the best transition temperature can be found from energy calculation and depends on both the condensing and the evaporating temperatures in the refrigeration system. Unlike this, in the thermal storage-heat exchanger a material with too high of a transition temperature cannot meet the refrigeration compartment temperature requirement. Because the refrigeration compartment temperature should be around 3–8° C. or 38–45° F., the best phase change materials are the materials with the transition temperature equal to or below 0–3° C. (32–37° F.). In other words, a phase change material has to have the transition temperature close to or lower than the freezing temperature of water. If the thermal storage has a hermetically sealed container, a phase change material may be other than water. For example, the eutectic from water and potassium nitrate has the transition temperature of −2.9° C. and can be considered a good candidate.

Figure 6:
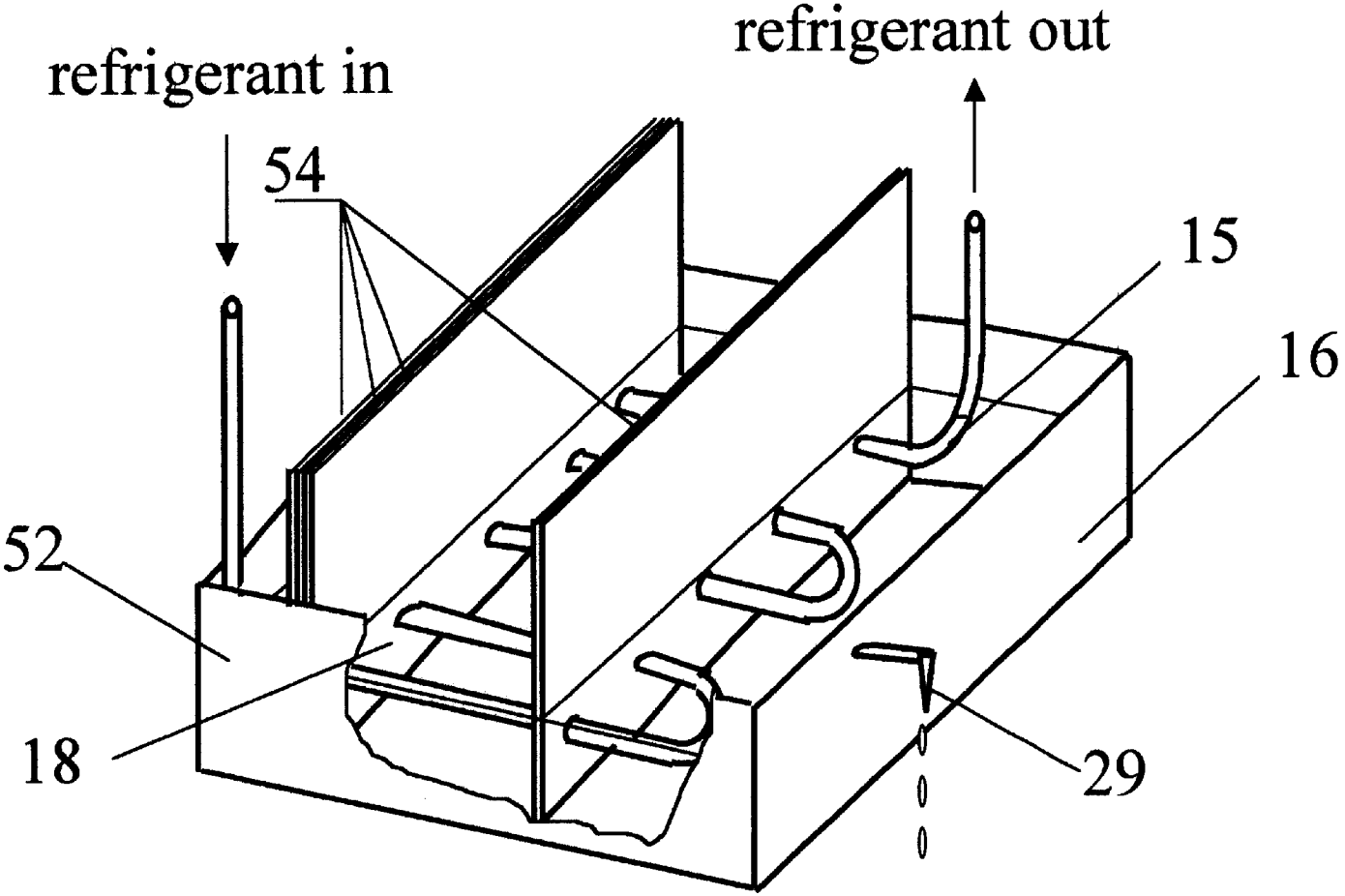
FIG. 6 shows a thermal storage with a water container opened to air, submerged in water refrigerant coil, and fins emerging from water to increase heat transfer surface contacting with the air.

2. Open container (FIG. 6). The preferable phase change material here is water. Water has high latent heat, very low cost, but the most important advantage is that water can be easily added and mixed with water vapor condensed from air. Thermal storage 16 with open container 52 is designed the way that the refrigerant coil is partly submerged in water 18 to freeze it. Part of finned surface 54 of the coil emerges from the water to increase the area for heat transfer between the air into the refrigeration compartment and the thermal storage. Extra amount of water condensed from air through line 29 spills into the defrost pan of the refrigerator.

To intensify heat transfer from the thermal storage, fan 17 (FIGS. 1, 1A, 2) may be installed. However, with well-developed surface 36 (FIG. 5) or fins 54 (FIG. 6) free convection may provide satisfactory temperature level especially for a part of the refrigeration compartment, for example, for a vegetable and/or a meat section.

Figure 7:
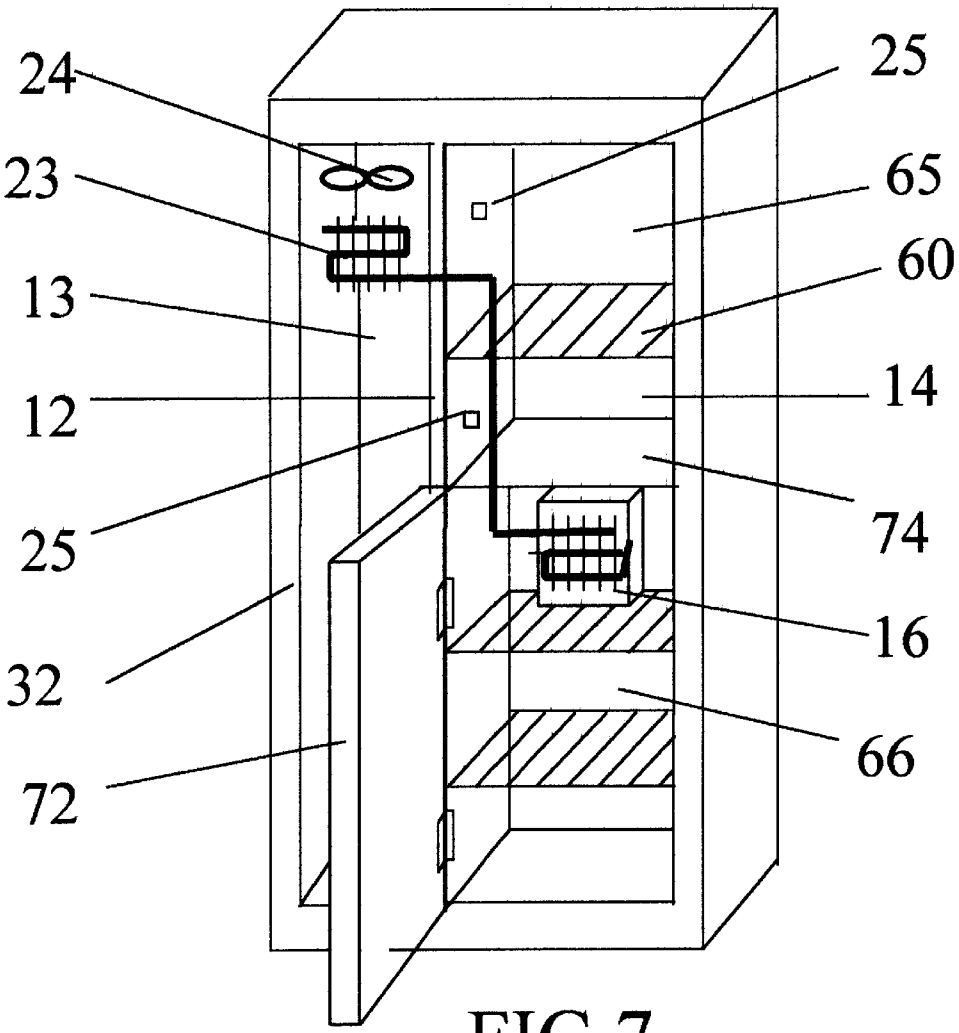
FIG. 7 depicts a schematic view of a refrigerator with a freezing compartment that includes an evaporator, a fresh food compartment with a thermal storage, and a mullion between the compartments, wherein the fresh food compartment is divided into two sections. The thermal storage is installed in one section in order to provide it with the cooling potential and the mullion has openings between the freezing compartment and the other section of the fresh food compartment in order to provide the cooling capacity to this section.

FIG. 7 shows refrigeration compartment 14 divided into two sections: a section with high humidity (for vegetable, fresh fruits, etc.) 65, and a section with low humidity 66. Both sections are equipped with shelves 60. Cooling potential into section 65 is provided by free convection from thermal storage 16. That keeps moisture from escaping section 65 and freezing on the surface of the evaporator. Cooling potential into section 66 is provided by the air exchange with freezing compartment 13 through openings 25 into mullion 12. The refrigerator has three doors. The doors of the freezing compartment 13 and low humidity section 66 of the fresh food compartment are not shown. Door 72 is the door for the high humidity section. Shelf 74 is solid and separates section 65 from section 66. Evaporator 23 and refrigerant coil 15 of thermal storage 16 are in series connections according to refrigeration system of FIGS. 1, 1A and 2.

I claim:

1. A refrigerator with at least one of refrigeration and/or freezing compartments and a compression refrigeration system operable in at least one of either a medium/low temperature cooling mode or a high/medium temperature cooling mode, the refrigeration system comprising a refrigerant circuit including a compressor and, in serial connection a compressor discharge line, a condenser, a first expansion device, a thermal storage with a thermal storage medium, a second expansion device, an evaporator, and a compressor suction line, a refrigerant bypass line for bypassing the second expansion device, a valve positioned to block flow through the bypass line, and control means for controlling the compressor and the valve.

2. The refrigeration system of claim 1, wherein the first expansion device is a first capillary tube.

3. The refrigeration system of claim 2, wherein the first capillary tube and the suction line of the compressor are in heat transfer communications.

4. The refrigeration system of claim 1, wherein the second expansion device is a second capillary tube.

5. The refrigeration system of claim 4, wherein the second capillary tube and the suction line of the compressor are in heat transfer communications.

6. The refrigeration system of claim 1, wherein the valve is a shut-off valve.

7. The refrigeration system of claim 1, wherein an inlet of the bypass line is connected to the thermal storage and an outlet of the bypass line is connected to the evaporator.

8. The refrigeration system of claim 1, wherein an inlet of the bypass line is connected to the thermal storage and an outlet of the bypass line is connected to the compressor suction line.

9. The refrigeration system of claim 8, wherein the valve is a three-way valve directing refrigerant flow either through the bypass line or through the second expansion device.

10. The refrigeration system of claim 9, further comprising a check valve after the evaporator to block refrigerant flow from the compressor suction line to the evaporator.

11. The refrigeration system of claim 1, further comprising a fan moving air around surfaces of the thermal storage to deliver high/medium temperature cooling potential to the refrigeration compartment.

12. The refrigeration system of claim 1, wherein the thermal storage comprises:

a container with a phase change material as a thermal storage medium, and a refrigerant coil to evaporate refrigerant extracting heat from the thermal storage medium and to condense and subcool refrigerant rejecting heat to the thermal storage medium.

13. The refrigeration system of claim 12, wherein the thermal storage container and the refrigerant coil are roll-bonded from metal sheets and wherein two internal sheets with formed internal channels make the refrigerant coil and external sheets with formed external channels make the thermal storage container for the thermal storage medium that is located between external walls of the internal sheets and internal walls of the external sheets.

14. The refrigeration system of claim 12, wherein the thermal storage container is filled with water and opened to air, and the refrigerant coil is submerged in water in the container with fins emerging from water to increase heat transfer surface contacting with the air.

15. A refrigerator with refrigeration and/or freezing compartments comprising a compressor with suction and discharge ports, the compressor insulated form the compartments, a condenser outside of the compartments, insulated side, top, bottom and back walls, at least one door to get into the refrigerator, a mullion between the compartments, a thermal storage, an evaporator in the freezing compartment, a first capillary tube, a second capillary tube, refrigeration lines connecting in series the compressor discharge, the condenser, the first capillary tube, the thermal storage, the second capillary tube, the evaporator, and the compressor suction, a bypass refrigeration line to bypass the second capillary tube, a refrigerant valve to direct refrigerant flow after the thermal storage either to the bypass line or to the second capillary tube, control means to control temperature in the compartments, the compressor and the valve operations.

16. The refrigerator of claim 15 further comprising a first fan in the freezing compartment to deliver negative thermal potential from the evaporator, and the control means further control the first fan operations.

17. The refrigerator of claim 16 further comprising a second fan in the refrigeration compartment to deliver negative thermal potential from the thermal storage, and the control means further control the second fan operations.

18. The refrigerator of claim 15, wherein the thermal storage comprises:

a container with a phase change material as a thermal storage medium and a refrigerant coil to evaporate refrigerant extracting heat from the thermal storage medium and to condense and subcool refrigerant rejecting heat to the thermal storage medium.

19. The refrigerator of claim 18, wherein the thermal storage container and the refrigerant coil are roll-bonded from metal sheets and wherein two internal sheets with formed internal channels make the refrigerant coil and external sheets with formed external channels make the thermal storage container for the thermal storage medium that is located between external walls of the internal sheets and internal walls of the external sheets.

20. The refrigerator of claim 18, wherein the thermal storage container is filled with water and opened to air, and the refrigerant coil is submerged in water in the container with fins emerging from water to increase heat transfer surface contacting with the air.

21. The refrigerator of claim 15, wherein the refrigeration compartment comprises of at least one of high and low humidity sections, and the thermal storage provides the cooling potential to the high humidity section.

22. The refrigerator of claim 21, wherein the mullion between the freezing compartment and the low humidity section of the refrigeration compartment has openings for air circulation.

23. The refrigerator of claim 15, wherein the refrigerant valve is a shut-off valve.

24. The refrigerator of claim 15, wherein the refrigerant valve is a three-way valve, the refrigerator further comprises a check valve after the evaporator to block refrigerant flow from the compressor suction to the evaporator.

25. A method for providing refrigeration to enclosed compartments with a compression refrigeration system, the system including a thermal storage to store high/medium temperature cooling potential, the thermal storage consisting of a container with a thermal storage medium and a refrigerant coil; the system having a compressor in serial connection, a compressor discharge line, a condenser, a first expansion device, the refrigerant coil of the thermal storage, a second expansion device, a medium/low temperature evaporator to provide medium/low temperature refrigeration, and a compressor suction line; a refrigerant bypass line for bypassing the second expansion device, and a valve in the refrigerant bypass line positioned to allow or to block flow through the bypass line, the method comprising the steps of a charge and a discharge of the thermal storage:

during the thermal storage charge:

flowing gaseous refrigerant in the refrigerant circuit from the compressor to the condenser to liquefy it, expanding liquid refrigerant after the condenser in the first expansion device, flowing refrigerant to the thermal storage, and evaporating it in the thermal storage refrigerant coil providing negative thermal potential to the thermal storage medium, flowing gaseous refrigerant after the thermal storage through the bypass line, flowing refrigerant to the compressor suction line;

during the thermal storage discharge:

flowing gaseous refrigerant in the refrigerant circuit from the compressor to the condenser to liquefy it, partly expanding liquid refrigerant after the condenser in the first expansion device, flowing refrigerant to the thermal storage, at least partly recondensing and subcooling refrigerant in the thermal storage refrigerant coil extracting negative thermal potential from the thermal storage medium, expanding subcooled refrigerant after the thermal storage in the second expansion device and evaporating it in the medium/low temperature evaporator providing medium/low temperature refrigeration to a first enclosed compartment, flowing gaseous refrigerant after the evaporator back to the compressor.

26. The method of claim 25, during the thermal storage charge step further comprising flowing refrigerant after the bypass line to the evaporator and then to the compressor suction line.

27. The method of claim 25, further providing high/medium temperature refrigeration to a second enclosed compartment during both the thermal storage charge and the thermal storage discharge steps extracting negative high/medium temperature thermal potential from the thermal storage medium to the second enclosed compartment.

* * * * *